US006321056B1

(12) United States Patent
Takami

(10) Patent No.: US 6,321,056 B1
(45) Date of Patent: Nov. 20, 2001

(54) DEVELOPING DEVICE FOR AN IMAGE FORMING APPARATUS

(75) Inventor: Nobuo Takami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/498,365

(22) Filed: Feb. 4, 2000

(30) Foreign Application Priority Data

Feb. 5, 1999 (JP) ..... 11-028445

(51) Int. Cl.[7] ..... G03G 15/09
(52) U.S. Cl. ..... 399/274; 399/104
(58) Field of Search ..... 399/104, 274, 399/277, 267, 284, 103

(56) References Cited

U.S. PATENT DOCUMENTS 4,596,455 * 6/1986 Kohyama et al. .
5,084,733 * 1/1992 Katoh et al. .
5,187,326 * 2/1993 Shirai .
5,926,670 7/1999 Furuta et al. .
5,970,278 10/1999 Munakata .
5,983,060 11/1999 Namekata et al. .
6,006,062 12/1999 Takahashi et al. .
6,038,414 * 3/2000 Inami et al. ..... 399/104

FOREIGN PATENT DOCUMENTS 58-174971 * 10/1983 (JP) .
02-298974 * 12/1990 (JP) .
03-294882 * 12/1991 (JP) .
6-244021 9/1994 (JP) .
9-26702 1/1997 (JP) .
9-274391 10/1997 (JP) .
10-333431 12/1998 (JP) .

* cited by examiner

*Primary Examiner*—Robert Beatty
(74) *Attorney, Agent, or Firm*—Oblon, Spivak, McClelland, Maier & Neustadt, P.C.

(57) ABSTRACT

A developing device for an image forming apparatus of the present invention is capable of implementing double regulation on the amount of a developer with a first regulating member and second regulating members. The second regulating members, having inclined portions, are positioned upstream of opposite ends of the first regulating member in the direction of developer conveyance. It is therefore possible to obviate the adhesion of the developer at the opposite ends of the first regulating member. Further, a magnetic force is weakened at the opposite ends of a developer carrier adjoining the first regulating member for the same purpose.

51 Claims, 8 Drawing Sheets

DEVELOPING DEVICE FOR AN IMAGE FORMING APPARATUS

BACKGROUND OF THE INVENTION

1. Field of the Invention

The present invention relates to a copier, facsimile apparatus, printer or similar image forming apparatus and more particularly to a developing device included in an image forming apparatus.

2. Discussion of the Background

Typical of a developing device for the above application includes a developer carrier made up of a magnet roller, a nonmagnetic sleeve rotatable around the magnet roller, and a pair of flanges supporting the magnet roller and sleeve. The problem with this type of developing device is that a developer tends to accumulate in an excessive amount on opposite end portions of the developer carrier and adhere to the sleeve and a photoconductive element. This is particularly true with a developing device of the type using color developers and setting a relatively low toner softening point by attaching importance to luster and transmission.

Technologies relating to the present invention are disclosed in, e.g., Japanese Patent Laid-Open Publication Nos. 6-244021, 9-26702, 9-274391, and 10-333431.

SUMMARY OF THE INVENTION

It is therefore an object of the present invention to provide a developing device capable of obviating the adhesion of a developer to a developer carrier and a photoconductive element ascribable to the presence of an excessive amount of developer at opposite ends of the developer carrier.

A developing device for developing a latent image electrostatically formed on an image carrier of the present invention includes a developer chamber for storing a developer consisting of toner and carrier. A developer carrier accommodates a magnetized body therein for conveying the developer deposited thereon to a developing region where the developer carrier faces the image carrier. A first regulating member regulates the thickness of the developer deposited on the developer carrier in a layer. A pair of second regulating members are respectively positioned upstream of opposite ends of the first regulating member in the direction in which the developer carrier conveys the developer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
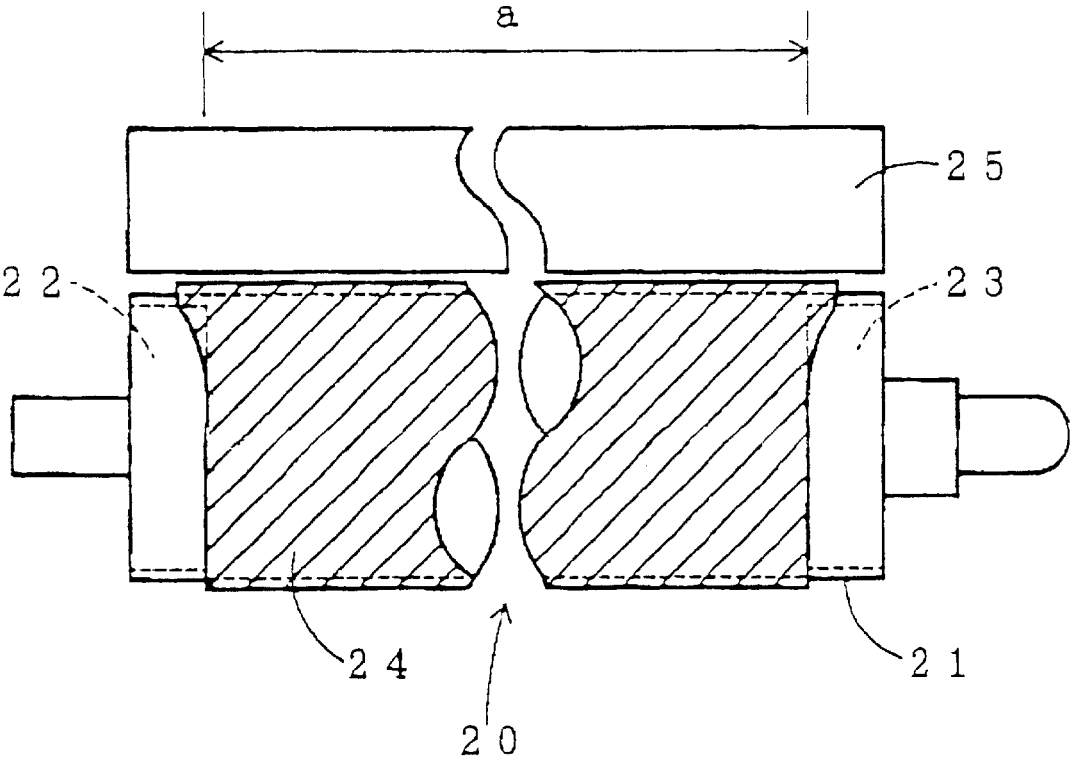
FIG. 1 PRIOR ART
FIG. 1 is a partly taken away view of a developer carrier included in a conventional developing device.

To better understand the present invention, brief reference will be made to a conventional developing device included in an image forming apparatus, shown in FIG. 1. As shown, the developing device includes a developer carrier 20 generally made up of a nonmagnetic sleeve 21 and a pair of flanges 22 and 23. The sleeve 21 accommodates a magnet roller having fixed magnetic poles and is rotatable around the magnet roller. The flanges 22 and 23 support the magnet roller and sleeve 21.

In the above configuration, the flanges 22 and 23 are fitted in opposite ends of the sleeve 21. It follows that the magnetic poles of the magnet roller each have a width a smaller than the axial length of the sleeve 21. Further, a developing width at a developing region is selected to be equal to or even slightly smaller than the above width a. In addition, a developer 24 is magnetically deposited on the sleeve 21 only over the width a and conveyed by the sleeve 21 in rotation.

The above conventional developing device has the following problem left unsolved. The developer 24 deposited on the sleeve 21 reaches a regulating member 25 from the upstream side in the direction of rotation of the sleeve 21. At this instant, the developer 24 spreads in the lengthwise direction of the regulating member 25 due to its own pressure and partly moves over the member 25 at a position outside of the width a of the magnetic poles. While this part of the developer 24 is conveyed toward a developing region, it is again magnetically drawn into the range of the width a and accumulates in an excessive amount at the opposite end portions of the developing width.

At the developing region, stress acts on the excessive developer accumulated between the sleeve 21 and a photoconductive element not shown, causing the developer to adhere to the sleeve 21 and photoconductive element. This is particularly true with a developing device of the type using color developers and setting a relatively low toner softening point where luster and transmission are important, as stated earlier.

Figure 2:
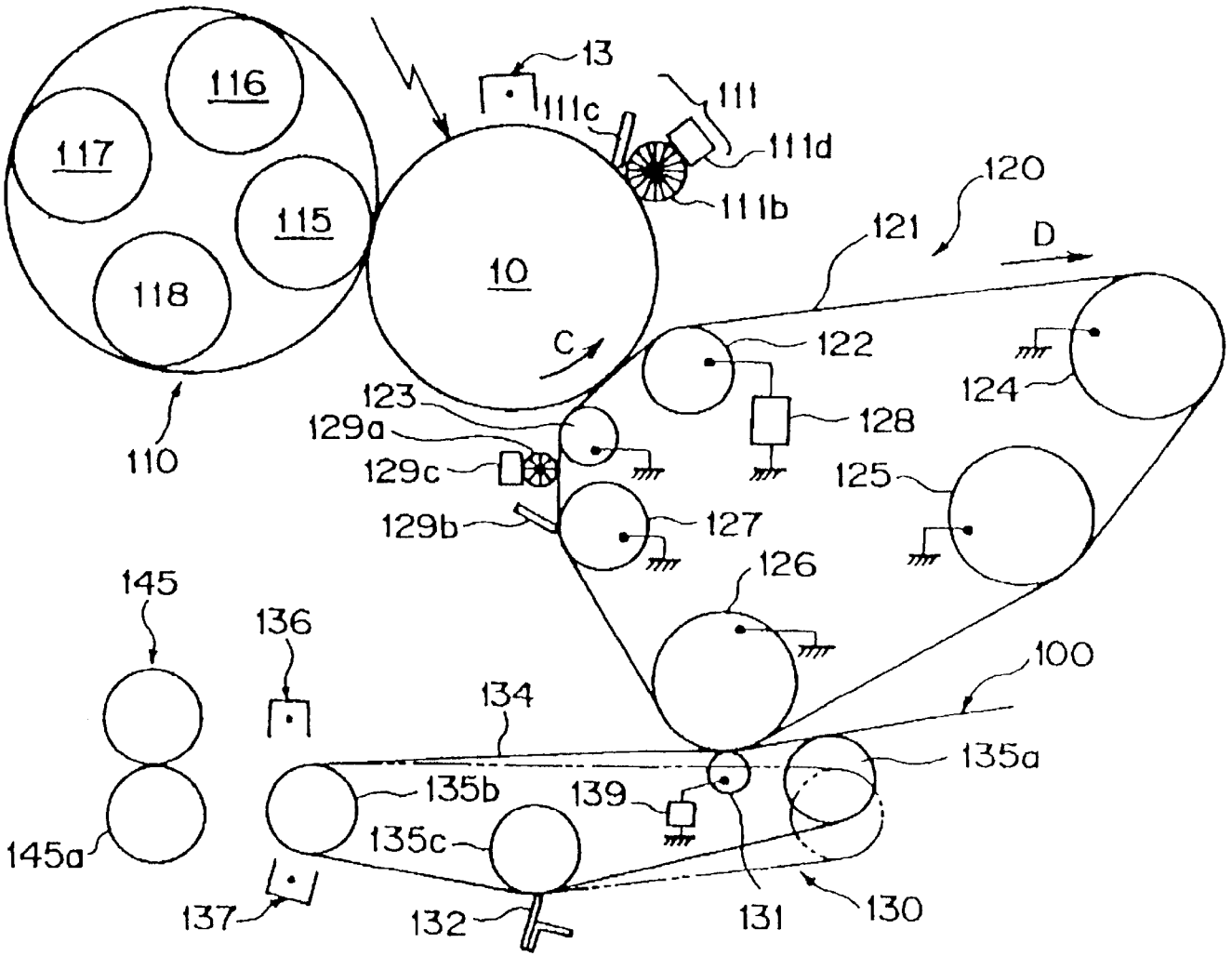
FIG. 2 is a view showing essential part of a printer section included in an image forming apparatus and to which the present invention is applied.

Preferred embodiments of the developing device in accordance with the present invention and free from the above problem will be described hereinafter. First, an image forming apparatus to which the present invention is applicable will be described which is implemented as a full-color electrophotographic copier by way of example. FIG. 2 shows a printer section included in the full-color copier. As shown, the printer section includes a photoconductive element implemented as a drum 10. An optical writing unit or exposing means, not shown, a drum cleaning unit or cleaning means 111, a charger or charging means 13, a rotary developing unit or developing means (revolver hereinafter) 110 and an intermediate image transfer unit or intermediate image transferring means 120 are arranged around the drum 10. The printer section further includes an image transfer unit or image transferring means 130, a fixing unit or fixing means 145 as well as a sheet feed section and a control section, not shown.

The drum cleaning unit 111 includes a fur brush 111*b* and a blade 111*c* which cleans the surface of the drum 10 after a primary transfer that will be described later. The fixing unit 145 includes a pair of fixing rollers 145*a* and a pair of outlet rollers not shown.

A solid lubricant 111*d* adjoins the fur brush 111*b* and contacts the tip of the brush 111*b*. The solid lubricant 111*ds* may be implemented by a flat molding of granular zinc stearate.

The revolver 110 includes a Bk (black) developing section 115, a C (cyan) developing section 116, an M (magenta) developing section 117, and a Y (yellow) developing section 118. The revolver 110 is rotatable to bring any one of the developing sections 115 through 118 to a developing region where the developing section faces the drum 10.

The intermediate image transfer unit 120 includes a belt or intermediate transfer body 121. The belt 121 is passed over a bias roller or charge depositing means 122, a ground roller or pretransfer discharging means 123, a drive roller or belt driving means 124, a tension roller 125, and counter rollers 126 and 127. A power supply 128 is connected to the bias roller 122. The bias roller 122, ground roller 123 and power source 128 join in primary image transfer while the counter roller 126 joins in secondary image transfer which will also be described later. The counter roller 127 contributes to the cleaning of the belt 121. All of the belt 121 and rollers over which it is passed are formed of conductive materials. The rollers other than the bias roller 122 are connected to ground.

The power supply 128 feeds a preselected primary transfer bias subjected to constant current control or constant voltage control to the bias roller 122. The belt 121 has a volume resistivity ranging from $10^{12}$ Ωcm to $10^{14}$ Ωcm, preferably $10^{13}$ Ωcm, and has a surface resistivity of $10^{7}$ Ωcm to $10^{14}$ Ωcm on its front.

A brush or lubricant applying means 129*a*, a belt cleaning blade 129*b* and the image transfer unit 130 also adjoin the belt 121, and each is movable into and out of contact with the belt 121 by being driven by a particular moving mechanism not shown.

The image transfer unit 130 includes a belt or paper support 134 for secondary image transfer. A cleaning blade 132 cleans the surface of the belt 134. A bias roller 131 for secondary image transfer faces the previously mentioned counter roller 126. A power supply 139 is connected to the bias roller 131. The belt 134 is passed over a first support roller 135*a*, a second support roller 135*b*, and a third support roller 135*c*. The support rollers 135*a* and 135*b* adjoin the sheet feed section and fixing unit 145, respectively. The support roller 135*c* faces the cleaning blade 132. Chargers 136 and 137 discharge a paper or similar recording medium and belt 134, respectively. The belt 134 is formed of polyvinylidene fluoride (PVDF) and has a relatively high volume resistivity of $10^{13}$ Ωcm or above. The belt 134 may, of course, be replaced with a drum or similar suitable member, if desired.

The operation of the above copier will be described hereinafter on the assumption that the revolver 110 sequentially develops latent images with Bk toner, C toner, M toner and Y toner.

Before the start of an image forming cycle, the drum 10 is rotated counterclockwise, i.e., in the direction indicated by an arrow C in FIG. 2 while the charger 113 starts corona discharge. Specifically, the charger 113 uniformly charges the surface of the drum 10 with, e.g., a negative charge to a preselected potential. The belt 121 of the intermediate image transfer unit 120 is caused to move clockwise, i.e., in the direction indicated by an arrow D in FIG. 2 at the same speed as the drum 10.

A scanner, not shown, reads color image information out of a document at a preselected timing while delivering them to the optical writing unit. The optical writing unit first writes an image based on Bk data included in the color image information with a laser beam (e.g. raster exposure). As a result, a Bk latent image represented by the Bk image data is formed on the drum 10.

The revolver 110 develops the Bk latent image with negatively charged Bk toner stored in the Bk developing section 115 by reversal development, thereby forming a Bk toner image on the drum 10. The Bk toner image is transferred from the drum 10 to the belt 121 by an electric field formed in a primary image transfer region (primary image transfer). Specifically, the bias roller 122 deposits a charge on the belt 121 so as to form the above electric field.

More specifically, the power supply 128 feeds to the bias roller 122 a bias of 1.5 kV for the Bk or first-color toner image, a bias of 1.6 kV to 1.8 kV for a C or second-color toner image, a bias of 1.8 kV to 2.0 kV for an M or third-color toner image, and a bias of 2.0 kV to 2.2 kV for a Y or fourth-color toner image. The drum cleaning unit 111 removes the toner left on the drum 10 after development.

The belt 121 carrying the Bk toner image transferred by primary image transfer again conveys it the toner image to the primary image transfer region. At this instant, the brush 129*a* and belt cleaning blade 129*b* are released from the belt 121 by the respective moving mechanism so as not to disturb the Bk toner image. Also, the first support roller 135*a* and bias roller 131 of the image transfer unit 130 are moved by the associated moving mechanism, so that the bias roller 131 is released from the belt 121. Further, the power supply 139 stops applying the voltage to the bias roller 131. This condition is maintained until secondary image transfer, i.e., the transfer of a composite or full-color toner image from the belt 121 to a paper 100.

After the above Bk image forming step, a C image forming step starts with the drum 10. Specifically, the scanner again reads the color image information out of the document at a preselected timing while delivering them to the optical writing unit. At this time, the optical writing unit writes an image based on C image data on the drum 10 with a laser beam and thereby forms a C latent image on the drum 10. The revolver 110 develops the C latent image with C toner stored on the C developing section 116, thereby forming a C toner image.

As soon as the trailing edge of the Bk latent image moves away from the developing position between the drum 10 and the revolver 110, the revolver 110 starts rotating. This rotation of the revolver 110 ends before the leading edge of the next or C latent image formed on the drum 10 arrives at the developing position. The C developing unit 116 is therefore successfully located at the developing position for developing the C latent image with the C toner.

Subsequently, the formation of a latent image, development and primary image transfer are repeated with an M image and a Y image in the same manner as with the C image. In this manner, Bk, C, M and Y toner images are sequentially transferred from the drum 10 to the belt 121 one above the other, completing a composite full-color image on the belt 121.

The belt 121 conveys the full-color image formed thereon to a secondary image transfer region between the belt 121 and the image transfer unit 130. At this time, the bias roller 131 of the image transfer unit 130 is pressed against the belt 121 by the associated moving mechanism. In this condition, the power supply 139 applies a preselected bias for secondary image transfer to the bias roller 131 in order to form an electric field at the secondary image transfer region. As a result, the full-color image is transferred from the belt 121 to the paper 100. Specifically, the paper 100 is fed at such a timing that its leading edge meets the leading edge of the full-color image at the secondary image transfer region.

The belt 134 conveys the paper 100 carrying the image to a position where the charger 136 is located. The charger 136 discharges the paper 100 so as to separate the paper 100 form the belt 134. The paper 100 is then brought to the fixing unit 145. The fixing unit 145 fixes the image on the paper 100 with the fixing rollers 145A by melting the image. The paper or copy 100 coming out of the fixing unit 145 is driven out to a copy tray (not shown).

After the secondary image transfer, the belt cleaning blade 129*b* is pressed against the belt 121 by the associated moving means and removes the toner left on the belt 121. To enhance the cleaning ability and secondary image transferability, the brush 129*a* is pressed against the belt 121 by the associated moving mechanism in order to apply a lubricant stored in a lubricant storing portion 129*c* to the belt 121. This lubricant may also be implemented by a flat molding of granular zinc stearate.

After the separation of the paper 100 from the belt 134, the charger 137 discharges the belt 134. Subsequently, the belt cleaning blade 132 cleans the belt 134.

Figure 3:
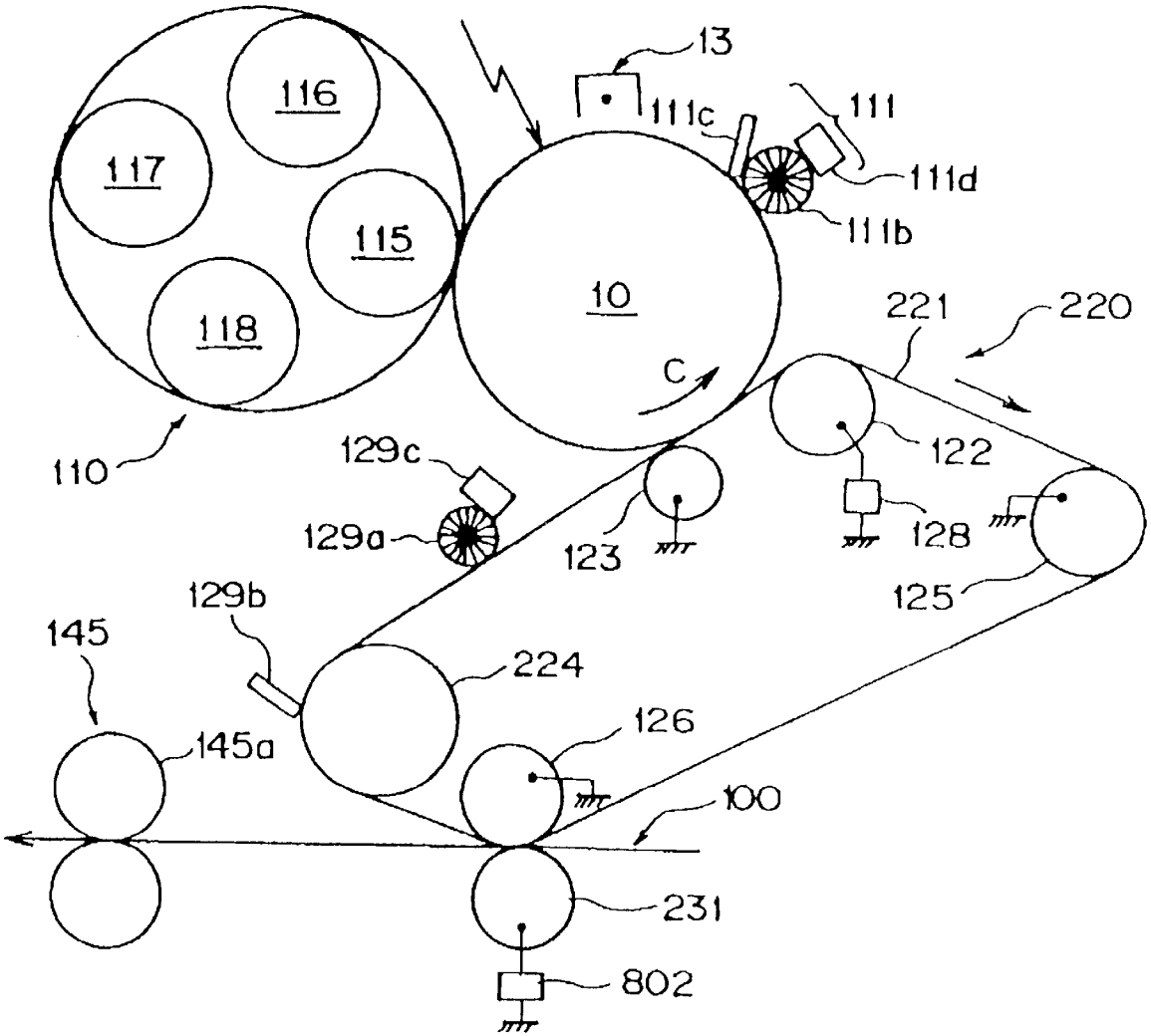
FIG. 3 is a view similar to FIG. 2, showing another specific configuration of the printer section.

FIG. 3 shows another specific configuration of the printer section. In the figures, the same or similar structural elements are designated by the same reference numerals. The printer section shown in FIG. 3 is essentially similar to the printer section of FIG. 2 except for the following.

In FIG. 3, an intermediate image transfer unit 220 includes a belt 221 including an intermediate layer that has a medium volume resistivity ranging from $10^8$ Ωcm to $10^{11}$ Ωcm. The belt 221 has a volume resistivity of $10^{10}$ Ωcm to $10^{12}$ Ωcm as a whole. The surface layer of the belt 221 has a surface resistivity of $10^7$ Ωcm to $10^{14}$ Ωcm. The belt 221 with such a medium resistance successfully obviates the irregular charging of the surface of the belt 221 after primary image transfer.

In the intermediate image transfer unit 220, a drive roller 224 is positioned upstream of the secondary image transfer region in the direction of rotation of the belt 221, but upstream of the primary image transfer region in the same direction. The belt cleaning blade 129*b* faces the drive roller 224. In this configuration, the drive roller 224 plays the role of the counter roller 127, FIG. 2, at the same time.

A bias roller 231 for secondary image transfer is substituted for the image transfer unit 130, FIG. 2, and located to face the counter roller 126 of the intermediate image transfer unit 220. This alternative arrangement reduces the number of structural elements necessary for secondary image transfer and therefore the cost, compared to the arrangement of FIG. 2. Further, the bias roller 231 and belt 221 directly nip the paper 100 fed thereto and convey it to the nip between the fixing rollers 145*a*.

Figure 4:
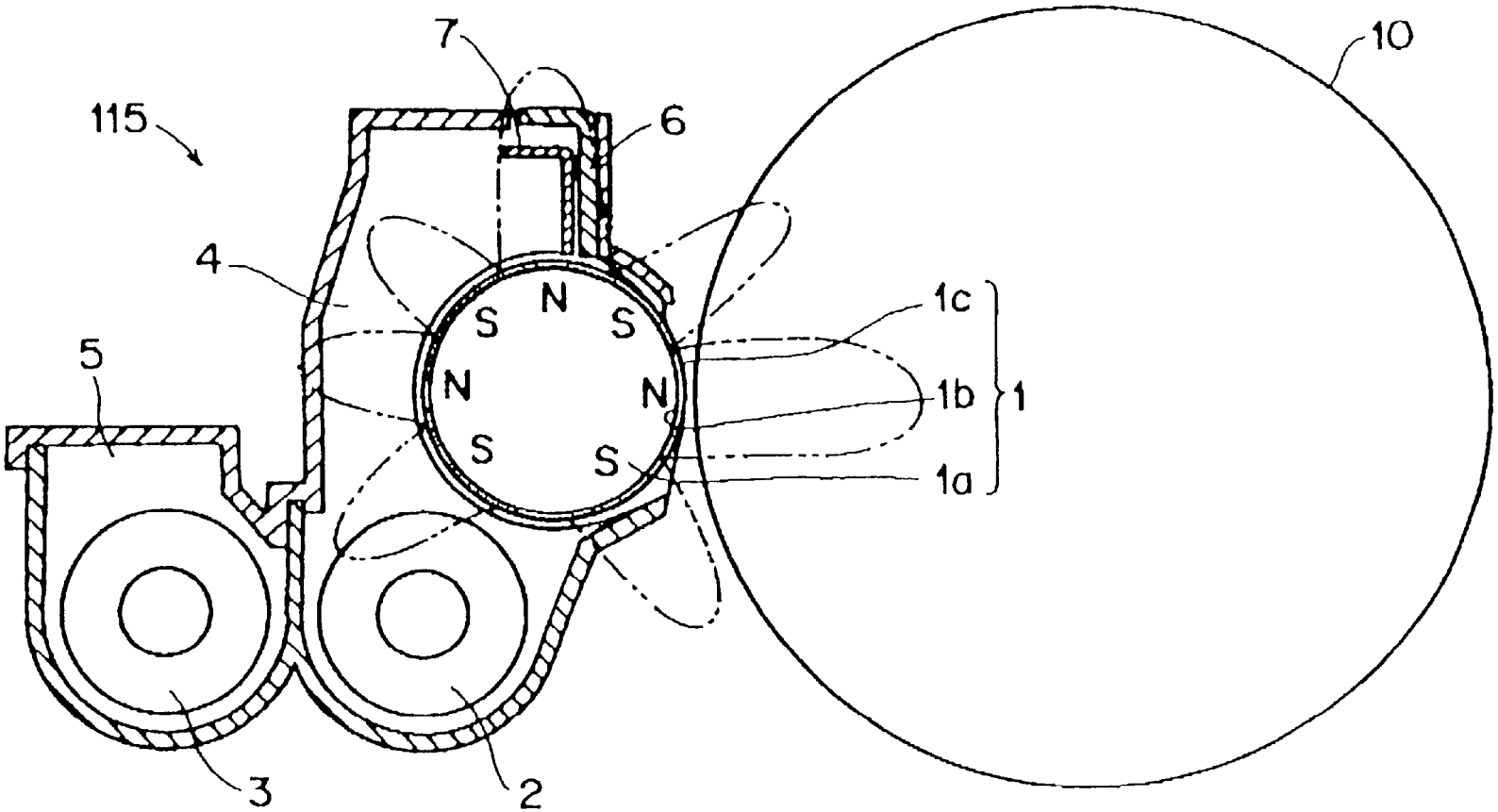
FIG. 4 is a section showing a developing device embodying the present invention.
Figure 5A:
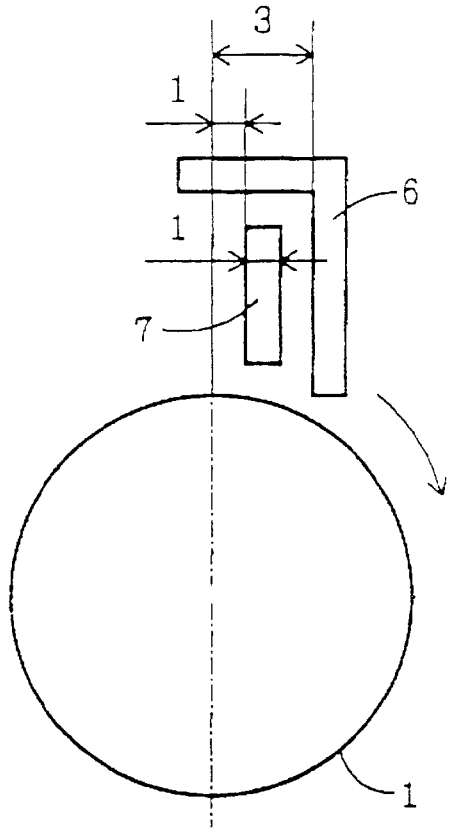
FIGS. 5A and 5B are fragmentary views showing a specific configuration of a predoctor included in the illustrative embodiment.
Figure 5B:
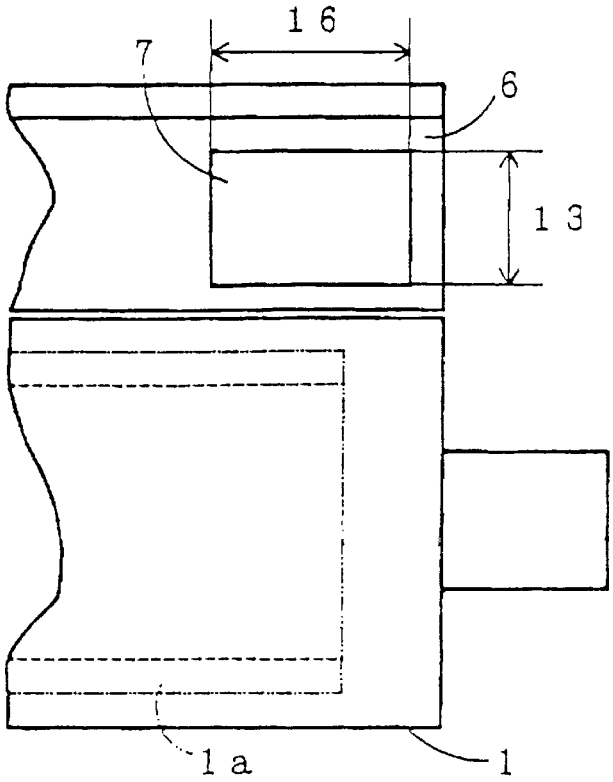

Referring to FIGS. 4, 5A and 5B, a developing device embodying the present invention will be described. While FIG. 4 shows only the Bk developing section 115, FIG. 2, facing the drum 10, the illustrative embodiment, of course, includes the C developing section 116, M developing section 117, and Y developing section 118 although not shown specifically. The following description will concentrate on the developing section 115 by way of example.

As shown, the developing section 115 includes a developing roller 1, conveyor screws 2 and 3, developer chambers 4 and 5, a doctor 6, and a predoctor 7. The developing roller 1 is made up of a magnet roller 1*b* accommodating a plurality of magnets 1*a* therein, and a sleeve 1*c* surrounding the magnet roller 1*b* for conveying a developer deposited thereon.

As shown in FIG. 5A, the predoctor 7 is positioned upstream of the doctor 6 in the direction of developer conveyance, i.e., in the direction of rotation of the developing roller 1. More specifically, as shown in FIG. 5B, a pair of predoctors 7 (only one being shown) respectively face opposite end portions of the doctor 6, and each extends over the boundary between the adjoining end of a developing region indicated by a dash-and-dots line and the outside of the developing region.

The developer chambers 4 and 5 each store a two-ingredient type developer, i.e., a toner and carrier mixture. The conveyor screws 2 and 3 are respectively disposed in the developer chambers 4 and 5, and each charges the developer by agitating it while circulating it in the associated chamber 4 or 5. The developer so charged by agitation is deposited on the surface of the sleeve c by the magnetic force of the magnet roller 1*b* and conveyed toward the drum 10 by the rotation of the sleeve 1*c*.

The doctor 6 regulates the thickness of the developer 1*c* being conveyed by the sleeve 1*c*. This allows the developer to reach-the developing region between the drum 10 and the developing section 115 in the form of a layer having an adequate thickness. In the developing region, the toner is separated from the carrier and transferred to the drum 10 so as to develop a latent image formed on the drum 10. The carrier is then returned to the developer chamber 4 by the sleeve 1*c*. Fresh toner is replenished from a toner chamber, not shown, to the developing section 115, as needed.

In the illustrative embodiment, as shown in FIGS. 5A and 5B, the predoctors 7 face the opposite end portions of the doctor 6 at a position upstream of the doctor 6 in the direction of rotation of the sleeve 1*c*. In this configuration, the developer deposited on the opposite end portions of the sleeve 1*c* is regulated in amount by the predoctors 7 and then by the doctor 6. Such double regulation prevents the developer from being conveyed to the developing region in an excessive amount and adhering to the sleeve 1*c* and drum 10.

The predoctors 7 are formed of a magnetic material and located at a region where a magnetic field normal to the magnet roller 1*b* exists and where the magnetic force of the magnet roller 1*b* in the direction normal to the roller 1*b* is greater than the doctor 6. In this condition, a magnetic field formed between the predoctors 7 and the sleeve 1*c* causes the developer to form a chain. This allows the predoctors 8 to efficiently regulate the amount of the developer being conveyed by the sleeve 1*c*.

Not the entire predoctors, but only part of the same facing the sleeve 1*c* may be formed of a magnetic material, if desired.

Figure 6:
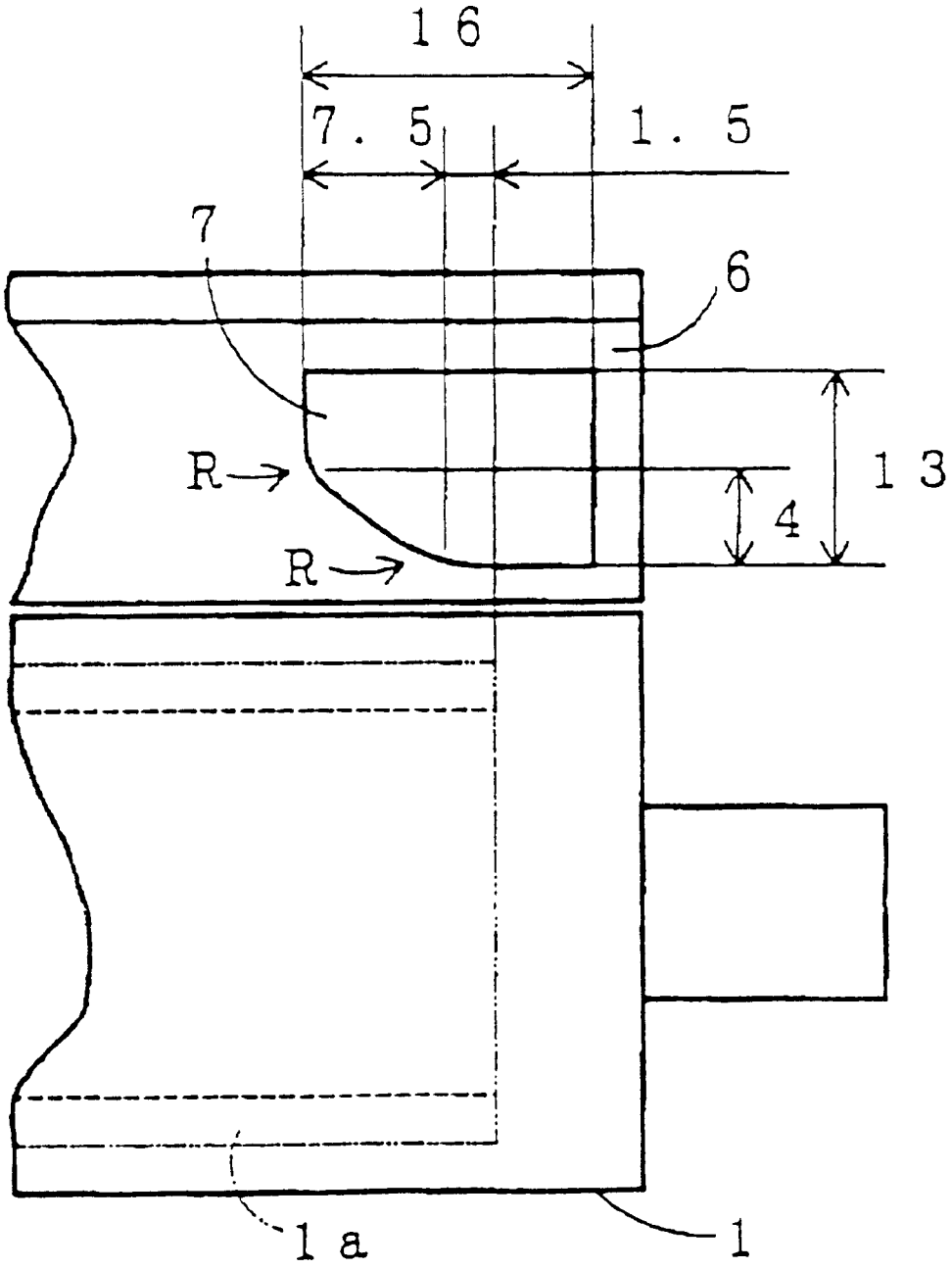
FIG. 6 is a fragmentary view showing another specific configuration of the predoctor.

Further, as shown in FIG. 6, each predoctor 7 may be obliquely cut toward the inside of the developing region and have opposite ends of the cut edge rounded (R) in order to obviate the adhesion of the developer more positively. While the predoctor 7 is shown as being linearly cut in FIG. 6, it may be cut with a curvature.

Figure 7:
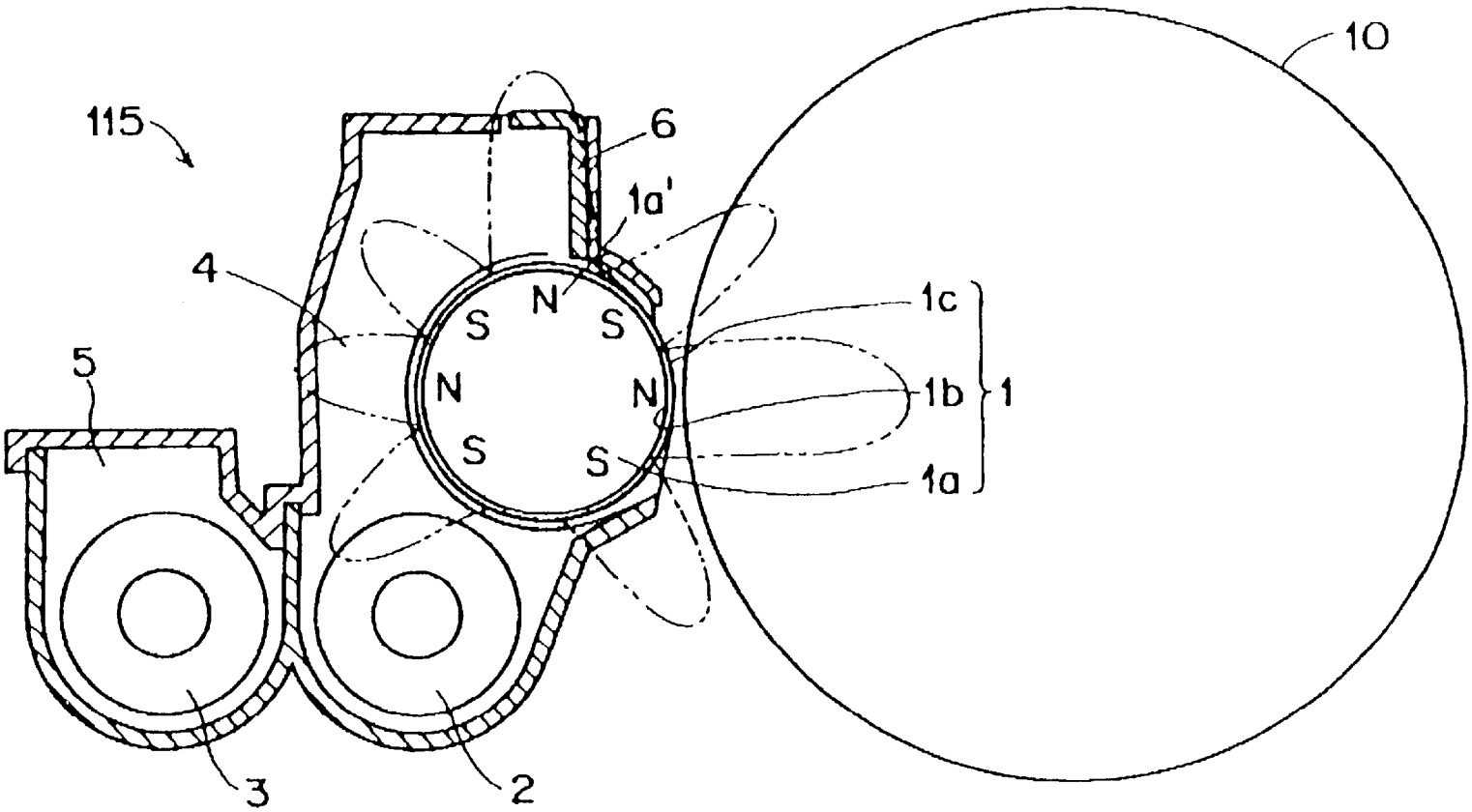
FIG. 7 is a cross-sectional view showing an alternative embodiment of the present invention.
Figure 8A:
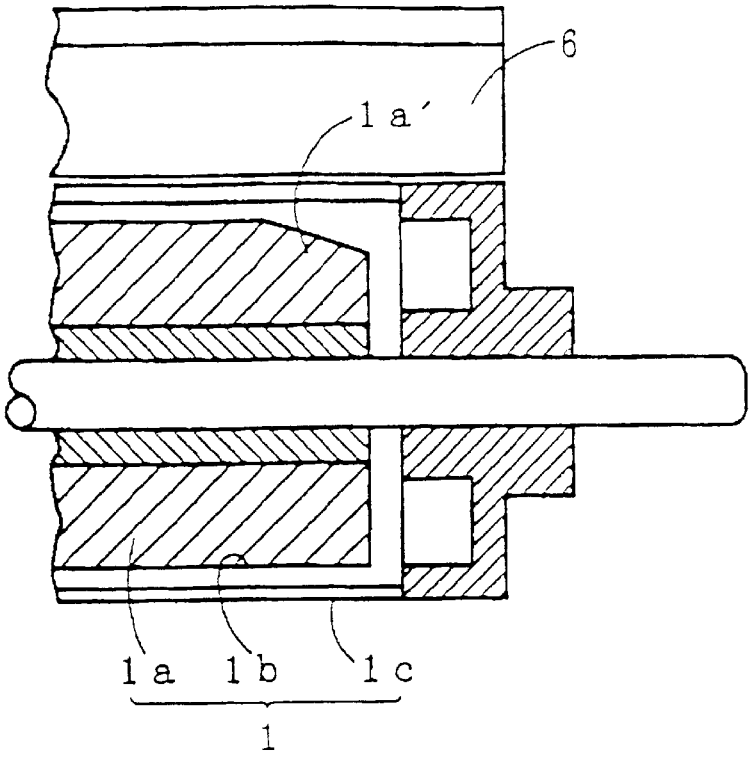
FIGS. 8A and 8B are fragmentary sections showing a developing roller included in the alternative embodiment.
Figure 8B:
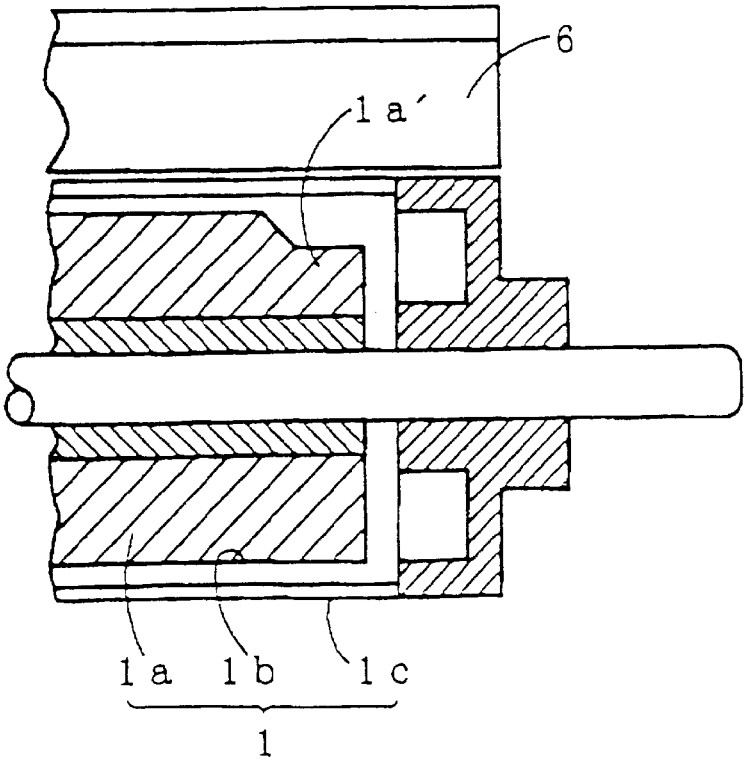

FIG. 7 shows an alternative embodiment of the developing device in accordance with the present invention. The alternative embodiment is identical with the previous embodiment except that the predoctors 7 are absent, and that the magnets 1*a* have a unique configuration. Specifically, as shown in FIG. 7, the magnets 1*a* include a magnet 1*a*' forming a magnetic field acting on the doctor 6 in the normal direction. As shown in FIGS. 8A and 8B, the magnet 1*a*' has its opposite ends cut and is thereby reduced in size. Specifically, the opposite ends of the magnet 1*a*' are obliquely cut in FIG. 8A or cut in parallel to the sleeve 1*c* in FIG. 8B.

By cutting the opposite ends of the magnet 1*a*' adjoining the doctor 6, as stated above, it is possible to increase the distance between the magnet 1*a*' and the sleeve 1*c* and therefore to weaken the magnetic force. This is successful to regulate the amount of the developer to move over the doctor 6 and therefore to obviate the adhesion of the developer.

While the above embodiment cuts the opposite ends of the magnetic 1*a*' in order to weaken the magnetic force, a bypass magnetic path may be formed for the same purpose, if desired.

In summary, it will be seen that the present invention provides a developing device capable of implementing double regulation on the amount of a developer with a first regulating member and second regulating members. The second regulating members are positioned upstream of opposite ends of the first regulating member in the direction of developer conveyance. It is therefore possible to obviate the adhesion of the developer at the opposite ends of the first regulating member. Further, a magnetic force is weakened at the opposite ends of a developer carrier adjoining the first regulating member for the above purpose.

Various modifications will become possible for those skilled in the art after receiving the teachings of the present disclosure without departing from the scope thereof.

What is claimed is:

1. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer wherein at least one of said regulating members includes an inclined portion inclined towards an inside portion of the developing region.

2. A developing device as claimed in claim 1, wherein said second regulating members are formed of a magnetic material.

3. A developing device as claimed in claim 2, wherein said second regulating members each extend over a boundary between an end of the developing region and an outside portion of said developing region.

4. A developing device as claimed in claim 3, wherein said second regulating members each include an edge facing said developer carrier and include said inclined portion inclined toward an inside portion of the developing region.

5. A developing device as claimed in claim 4, wherein opposite ends of said inclined portion are rounded.

6. A developing device as claimed in claim 5, wherein said second regulating members each are located at a position where a magnetic force in a direction normal to said magnetized body is greater than said first regulating member.

7. A developing device as claimed in claim 4, wherein said second regulating members each are located at a position where a magnetic force in a direction normal to said magnetized body is greater than said first regulating member.

8. A developing device as claimed in claim 3, wherein said second regulating members each include an edge facing said developer carrier and including a curved portion curved toward an inside of the developing region.

9. A developing device as claimed in claim 8, wherein said second regulating members each are located at a position where a magnetic force in a direction normal to said magnetized body is greater than said first regulating member.

10. A developing device as claimed in claim 3, wherein said second regulating members each are located at a position where a magnetic force in a direction normal to said magnetized body is greater than said first regulating member.

11. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein said second regulating members are formed of a magnetic material, and wherein said second regulating members each include an edge facing said developer carrier and include an inclined portion inclined toward an inside of the developing region.

12. A developing device as claimed in claim 11, wherein opposite ends of said inclined portion are rounded.

13. A developing device as claimed in claim 12, wherein said second regulating members each are located at a position where a magnetic force in a direction normal to said magnetized body is greater than said first regulating member.

14. A developing device as claimed in claim 11, wherein said second regulating members each are located at a position where a magnetic force in a direction normal to said magnetized body is greater than said first regulating member.

15. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein said second regulating members are formed of a magnetic material, and wherein said second regulating members each include an edge facing said developer carrier and include a curved portion curved toward an inside of the developing region.

16. A developing device as claimed in claim 15, wherein said second regulating members each are located at a position where a magnetic force in a direction normal to said magnetized body is greater than said first regulating member.

17. A developing device as claimed in claim 2, wherein said second regulating members each are located at a position where a magnetic force in a direction normal to said magnetized body is greater than said first regulating member.

18. A developing device as claimed in claim 1, wherein portions of said second regulating members facing said developer carrier are formed of a magnetic material.

19. A developing device as claimed in claim 18, wherein said second regulating members each extend over a boundary between an end of the developing region and an outside of said developing region.

20. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein portions of said second regulating members facing said developer carrier are formed of a magnetic material;

wherein said second regulating members each extend over a boundary between an end of the developing region and an outside of said developing region; and wherein said second regulating members each include an edge facing said developer carrier and include an inclined portion inclined toward an inside of the developing region.

21. A developing device as claimed in claim 20, wherein opposite ends of said inclined portion are rounded.

22. A developing device as claimed in claim 21, wherein said second regulating members each are located at a position where a magnetic force in a direction normal to said magnetized body is greater than said first regulating member.

23. A developing device as claimed in claim 20, wherein said second regulating members each are located at a position where a magnetic force in a direction normal to said magnetized body is greater than said first regulating member.

24. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein portions of said second regulating members facing said developer carrier are formed of a magnetic material;

wherein said second regulating members each extend over a boundary between an end of the developing region and an outside of said developing region; and wherein said second regulating members each include an edge facing said developer carrier and include a curved portion curved toward an inside of the developing region.

25. A developing device as claimed in claim 24, wherein said second regulating members each are located at a position where a magnetic force in a direction normal to said magnetized body is greater than said first regulating member.

26. A developing device as claimed in claim 19, wherein said second regulating members each are located at a position where a magnetic force in a direction normal to said magnetized body is greater than said first regulating member.

27. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein portions of said second regulating members facing said developer carrier are formed of a magnetic material; and wherein said second regulating members each include an edge facing said developer carrier and include an inclined portion inclined toward an inside of the developing region.

28. A developing device as claimed in claim 27, wherein opposite ends of said inclined portion are rounded.

29. A developing device as claimed in claim 28, wherein said second regulating members each are located at a position where a magnetic force in a direction normal to said magnetized body is greater than said first regulating member.

30. A developing device as claimed in claim 27, wherein said second regulating members each are located at a position where a magnetic force in a direction normal to said magnetized body is greater than said first regulating member.

31. A developing device for developing a latent image electrostatically formed on an image carrier, said developing device comprising:

a developer chamber for storing a developer consisting of toner and carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein portions of said second regulating members facing said developer carrier are formed of a magnetic material; and wherein said second regulating members each include an edge facing said developer carrier and include a curved portion curved toward an inside of the developing region.

32. A developing device as claimed in claim 31, wherein said second regulating members each are located at a position where a magnetic force in a direction normal to said magnetized body is greater than said first regulating member.

33. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein portions of said second regulating members facing said developer carrier are formed of a magnetic material;

wherein said second regulating members each are located at a position where a magnetic force in a direction normal to said magnetized body is greater than said first regulating member and, wherein said second regulating members each include an edge facing said developer carrier and including an inclined portion inclined toward an inside of the developing region.

34. A developing device as claimed in claim 1, wherein said second regulating members each extend over a boundary between an end of the developing region and an outside of said developing region.

35. A developing device for developing a latent image electrostatically formed on an image carrier, said developing device comprising:

a developer chamber for storing a developer comprising a toner and a carrier;

a developer carrier accommodating a magnetized body therein for conveying the developer deposited there on to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein said second regulating members each extend over a boundary between an end of the developing region and an outside portion of said developing region; and wherein said second regulating members each include an edge facing said developer carrier and including an inclined portion inclined toward an inside of the developing region.

36. A developing device as claimed in claim 35, wherein opposite ends of said inclined portion are rounded.

37. A developing device as claimed in claim 36, wherein said second regulating members each are located at a position where a magnetic force in a direction normal to said magnetized body is greater than said first regulating member.

38. A developing device as claimed in claim 35, wherein said second regulating members each are located at a position where a magnetic force in a direction normal to said magnetized body is greater than said first regulating member.

39. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein said second regulating members each extend over a boundary between an end of the developing region and an outside portion of said developing region; and wherein said second regulating members each include an edge facing said developer carrier and include a curved portion curved toward an inside of the developing region.

40. A developing device as claimed in claim 39, wherein said second regulating members each are located at a position where a magnetic force in a direction normal to said magnetized body is greater than said first regulating member.

41. A developing device as claimed in claim 34, wherein said second regulating members each are located at a position where a magnetic force in a direction normal to said magnetized body is greater than said first regulating member.

42. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein said second regulating members each include an edge facing said developer carrier and include an inclined portion inclined toward an inside of the developing region.

43. A developing device as claimed in claim 42, wherein opposite ends of said inclined portion are rounded.

44. A developing device as claimed in claim 43, wherein said second regulating members each are located at a position where a magnetic force in a direction normal to said magnetized body is greater than said first regulating member.

45. A developing device as claimed in claim 42, wherein said second regulating members each are located at a position where a magnetic force in a direction normal to said magnetized body is greater than said first regulating member.

46. A developing device for developing a latent image electrostatically formed on an image carrier, said developing device comprising:

a developer chamber for storing a developer comprising a toner and a carrier;

a developer carrier accommodating a magnetized body therein for conveying the developer deposited thereon to a developing region where said developer carrier faces the image carrier;

a first regulating member for regulating a thickness of the developer deposited on said developer carrier in a layer; and a pair of second regulating members respectively positioned upstream of opposite ends of said first regulating member in a direction in which said developer carrier conveys the developer;

wherein said second regulating members each include an edge facing said developer carrier and include a curved portion curved toward an inside of the developing region.

47. A developing device as claimed in claim 46, wherein said second regulating members each are located at a position where a magnetic force in a direction normal to said magnetized body is greater than said first regulating member.

48. A developing device as claimed in claim 1, wherein said second regulating members each are located at a position where a magnetic force in a direction normal to said magnetized body is greater than said first regulating member.

49. A developing device for developing a latent image electrostatically formed on an image carrier, comprising:

a developer chamber for storing a developer consisting of toner and carrier;

a developer carrier accommodating a magnetized body therein for conveying the developer deposited thereon to a developing region where said developer carrier faces the image carrier; and a regulating member for regulating a thickness of the developer deposited on said developer carrier in a layer;

wherein a magnetic force exerted by said magnetized body on said regulating member is weakened at opposite ends of said regulating member, said regulating member including an inclined portion inclined towards an inside portion of the developing region.

50. A developing device as claimed in claim 49, wherein said magnetized body is so configured as to weaken the magnetic force at opposite ends thereof.

51. A developing device as claimed in claim 50, wherein a distance between said regulating member and said magnetized body is increased at opposite ends of said magnetized body for thereby weakening the magnetic force.

* * * * *